US011173382B2

(12) United States Patent
Augustin

(10) Patent No.: US 11,173,382 B2
(45) Date of Patent: Nov. 16, 2021

(54) SKATEBOARD AXLE ASSEMBLY AND SKATEBOARD

(71) Applicants: Stephan Augustin, Munich (DE); Stefan Rolf Habermann, Utting am Ammersee (DE)

(72) Inventor: Stephan Augustin, Munich (DE)

(73) Assignees: Stephan Augustin; Stefan Rolf Habermann

( * ) Notice: Subject to any disclaimer, the term of this patent is extended or adjusted under 35 U.S.C. 154(b) by 317 days.

(21) Appl. No.: 16/091,964

(22) PCT Filed: Apr. 25, 2017

(86) PCT No.: PCT/EP2017/059694
§ 371 (c)(1),
(2) Date: Oct. 5, 2018

(87) PCT Pub. No.: WO2017/186656
PCT Pub. Date: Nov. 2, 2017

(65) Prior Publication Data

US 2019/0118069 A1 Apr. 25, 2019

(30) Foreign Application Priority Data

Apr. 25, 2016 (DE) ..... 10 2016 107 640.6

(51) Int. Cl.
*A63C 17/01* (2006.01)

(52) U.S. Cl.
CPC ..... *A63C 17/013* (2013.01); *A63C 17/01* (2013.01); *A63C 17/012* (2013.01); *A63C 17/015* (2013.01)

(58) Field of Classification Search
CPC ... A63C 17/01; A63C 17/0093; A63C 17/012; A63C 17/013; A63C 17/011
See application file for complete search history.

(56) References Cited

U.S. PATENT DOCUMENTS 4,054,297 A * 10/1977 Solimine ..... A63C 17/01 280/87.042
4,550,926 A 11/1985 MacIsaac ..... 280/112
4,645,223 A * 2/1987 Grossman ..... A63C 17/0046 280/11.28

(Continued)

FOREIGN PATENT DOCUMENTS

CN 104228527 12/2014 ..... B60H 1/34
CN 109091853 12/2018 ..... A63C 17/01

(Continued)

OTHER PUBLICATIONS

Chinese Search Report issued in application No. 2017800256217, dated May 18, 2019 (1 pg).

(Continued)

*Primary Examiner* — Emma K Frick
(74) *Attorney, Agent, or Firm* — Hayes Soloway P.C.

(57) ABSTRACT

A skateboard axle assembly is described, having a connection plate for mounting the axle assembly to a skateboard deck and a wheel axle. The wheel axle has two ends, to each of which a wheel can be mounted. The wheel axle is movably coupled to the connection plate by two articulated arms. In addition, a skateboard having at least one skateboard axle assembly is described.

16 Claims, 8 Drawing Sheets

(56) References Cited

U.S. PATENT DOCUMENTS

| | | | | |
|---|---|---|---|---|
| 4,681,333 | A * | 7/1987 | Rouge | A63C 17/006 280/11.28 |
| 5,263,725 | A * | 11/1993 | Gesmer | A63C 17/0093 280/11.28 |
| 5,330,214 | A | 7/1994 | Brooks et al. | 280/87.042 |
| 5,522,620 | A | 6/1996 | Pracas | 280/87.041 |
| 5,975,229 | A * | 11/1999 | Hosoda | A63C 17/12 180/180 |
| 6,224,076 | B1 * | 5/2001 | Kent | A63C 17/0046 280/11.28 |
| 6,286,843 | B1 * | 9/2001 | Lin | A63C 17/0066 280/11.28 |
| 6,299,186 | B1 * | 10/2001 | Kao | B62K 3/002 280/11.28 |
| 6,398,238 | B1 * | 6/2002 | Shaw | B62K 3/002 280/11.28 |
| 6,659,480 | B1 * | 12/2003 | Newman | A63C 17/01 280/87.042 |
| 6,793,224 | B2 | 9/2004 | Stratton | 280/87.042 |
| 6,832,765 | B1 * | 12/2004 | Walton | A63C 17/265 280/11.221 |
| 6,863,283 | B1 * | 3/2005 | Houston | A63C 17/0046 280/11.225 |
| 7,044,485 | B2 * | 5/2006 | Kent | A63C 17/0093 280/11.28 |
| 7,104,558 | B1 * | 9/2006 | Saldana | A63C 17/0093 280/11.27 |
| 7,226,063 | B2 * | 6/2007 | Paddock | A63C 17/01 280/11.28 |
| 7,287,762 | B2 | 10/2007 | Stratton | 280/11.27 |
| 8,186,694 | B2 * | 5/2012 | Nelson | B60G 9/02 280/11.28 |
| 8,752,849 | B1 * | 6/2014 | Fox | A63C 17/0093 280/87.042 |
| 9,789,412 | B2 * | 10/2017 | Mainville | A63H 3/02 |
| 9,919,585 | B2 | 3/2018 | Noichl et al. | B60H 1/3421 |
| 10,265,606 | B1 * | 4/2019 | Chung | A63C 17/012 |
| 10,376,773 | B2 * | 8/2019 | Chung | A63C 17/012 |
| 2006/0006622 | A1 * | 1/2006 | Gesmer | A63C 17/012 280/87.042 |
| 2007/0001415 | A1 | 1/2007 | Cole | 280/87.042 |
| 2011/0042913 | A1 * | 2/2011 | Landau | A63C 17/012 280/87.042 |
| 2011/0089659 | A1 * | 4/2011 | Hunt | A63C 17/0093 280/124.121 |
| 2016/0023087 | A1 | 1/2016 | Corrales et al. | A63C 17/017 |
| 2016/0023088 | A1 | 1/2016 | Aamodt | A63C 17/017 |
| 2016/0045814 | A1 | 2/2016 | Zhou | A63C 17/12 |
| 2020/0282294 | A1 * | 9/2020 | Anderson | A63C 17/02 |

FOREIGN PATENT DOCUMENTS

| | | | |
|---|---|---|---|
| DE | 4441642 | 4/1995 | A63C 17/01 |
| DE | 102006057167 | 6/2008 | A63C 17/02 |
| WO | WO2015084978 | 6/2015 | A63C 17/12 |

OTHER PUBLICATIONS

International Search Report and Written Opinion issued in application No. PCT/EP2017/059694, dated Jun. 30, 2017 (14 pgs).

International Preliminary Report on Patentability issued in application No. PCT/EP2017/059694, dated Nov. 8, 2018 (6 pgs).

Chinese Office Action (w/translation) issued in application No. 201780025621.7, dated Sep. 16, 2019 (8 pgs).

* cited by examiner

SKATEBOARD AXLE ASSEMBLY AND SKATEBOARD

BACKGROUND OF THE INVENTION

The present invention relates to a skateboard axle assembly having a connection plate for mounting the axle assembly to a skateboard deck and a wheel axle having two ends, to each of which a wheel can be mounted.

In addition, the present invention relates to a skateboard having at least one skateboard axle assembly of the type initially mentioned.

In generic skateboard axle assemblies known from the prior art, the wheel axle is mounted on the connection plate by means of two pins. Both pins are arranged in the middle of the wheel axle. A first pin is received in a bearing cup at the connection plate such that the wheel axle can rotate about this pin. A second pin, the so-called kingpin, is tilted about the wheel axle with respect to the first pin and is firmly connected with the connection plate. The kingpin is usually formed as a setscrew. The wheel axle is supported at the kingpin by means of elastic sleeves which are placed on the kingpin. The wheel axle can thus be pivoted about the first pin, accompanied by a compression of the elastic sleeves. The elastic sleeves are also referred to as bushings.

The bushings can be compressed to a greater or lesser extent by tightening a so-called kingpin nut, which is screwed on the kingpin. In this way, the hardness of the steering of the skateboard is adjusted. When the kingpin nut is screwed down very tightly, a good directional stability of the skateboard running steadily straight ahead is obtained. When the kingpin nut is screwed down less tightly, an agile cornering ability of the skateboard is enhanced. This is at the expense of a steady directional stability. Adjusting the steering hardness via the kingpin nut usually requires the use of tools.

The design of conventional skateboard axle assemblies with the bushings constitutes a degressive system. This means that when moving straight ahead, a skateboarder stands at the highest point, i.e. in an unstable position. To make a turn, he has to incline the skateboard deck towards one of the side edges, with the skateboard deck descending slightly towards the ground or roadway.

These conventional skateboard axles have already been further developed with the aim of allowing tighter curve radii. In addition, there are developments that make it possible to propel the skateboard forward without pushing with the feet, the so-called pumping.

In this connection, U.S. Pat. No. 7,287,762 B2, for example, shows a skateboard having a skateboard axle assembly in which the horizontal distance of the wheel axle from the kingpin nut was increased to allow smaller curve radii. In principle, however, the skateboard axle assembly shown here is based on the conventional principle, so that propelling the skateboard by pumping is not possible with this axle assembly.

U.S. Pat. No. 5,522,620 A addresses the problem of propelling the skateboard by pumping. To this end, a conventional skateboard front axle is mounted on an arm which is mounted about a vertical joint pin at the skateboard deck. The joint pin is arranged in front of the wheel axle here. The rotary arm may be selectively blocked or released.

U.S. Pat. No. 6,793,224 B2 also shows a skateboard axle assembly in which a conventional front axle is mounted on a rotary arm. The background of this skateboard axle assembly is to allow reduced curve radii and a propelling of the skateboard by pumping. The rotary arm on which the conventional type wheel axle is mounted is loaded to a neutral position by a spring. The neutral position here corresponds to the straight-ahead travel of the skateboard.

Further, DE 10 2006 057 167 A1 shows a skateboard the front wheels of which are each steerable about a substantially vertical axis. This can be reached by tilting the skateboard deck about a longitudinal axis, with each front wheel having a longitudinal control arm associated to it, which is connected to the skateboard deck by means of a connecting strut.

U.S. Pat. No. 5,330,214 A furthermore discloses a skateboard axle assembly in which the wheels of the skateboard are tilted during steering. For this purpose, the wheels of one axle are connected to two pins which, for steering, can be shifted against each other in the direction of the axle.

SUMMARY OF THE INVENTION

It is the object of the present invention to further improve a skateboard axle assembly which allows both small curve radii and a propelling of a skateboard by pumping.

The object is achieved by a generic skateboard axle assembly in which the wheel axle is movably coupled to the connection plate by means of two articulated arms.

In contrast to conventional skateboard axle assemblies, bushings or springs are preferably no longer required and no longer provided here. Accordingly, this eliminates the effort of adjusting the steering of the skateboard. Any tooling necessary therefor is dispensable. The two articulated arms are configured as separate parts here.

The skateboard axle assembly is configured such that when traveling straight ahead, the connection plate is located at the lowest point above the wheel axle and therefore above the ground or the roadway, and that the connection plate is raised when inclined. Accordingly, a rider of a skateboard having the skateboard axle assembly is at the lowest point when traveling straight ahead. If he/she wishes to make a turn, he/she has to incline the skateboard deck towards one of the two edges facing in the direction of travel. In the process, the skateboard deck and thus the connection plate of the skateboard axle assembly are slightly raised. This configuration causes the weight of the skateboard rider to act as a restoring force on the skateboard axle assembly, which results in the skateboard axle assembly always being returned to a stable position which corresponds to straight-ahead travel, without the need for any separate spring elements to be integrated for this purpose. A build-up of oscillations is also excluded. In addition, this skateboard axle assembly makes it possible to propel the skateboard in a simple manner by pumping. Furthermore, this design of the skateboard axle assembly allows larger steering angles than with conventional axles, so that smaller curve radii can be realized. For a skateboard rider this results in a riding feel that corresponds to surfing or snowboarding. The skateboard axle assembly can be mounted to the skateboard deck in two orientations and can be used both as a front axle assembly and as a rear axle assembly.

Preferably, the two articulated arms are arranged symmetrically with respect to a central axis extending in the direction of travel of the skateboard axle assembly when the skateboard axle assembly is in a neutral position, which corresponds to the straight ahead movement of the skateboard. The forces in the articulated arms thus also have a symmetrical profile.

According to one embodiment, the articulated arms are each supported at the wheel axle for rotation about a pivot on the wheel axle side, in particular a joint pin, and are each supported at the connection plate for rotation about a pivot on the connection plate side, in particular a joint pin. In this way, the structure of a four-joint mechanism is obtained. This four-joint mechanism constitutes a quadrangle, one side of which is formed by the wheel axle and the opposite side of which is formed by the connection plate. The other two sides are formed by the articulated arms. The use of joint pins allows a precise turn-in ability to be realized. In addition, joint pins are subjected only to low wear.

Preferably, the pivots on the wheel axle side are spaced apart from each other along the wheel axle and the pivots on the connection plate side are spaced apart from each other along a transverse direction of the connection plate, the distance between the two pivots on the wheel axle side being more particularly 2 to 2.5 times as large as the distance between the pivots on the connection plate side. Here, the transverse direction of the connection plate is a direction defined on the connection plate, which is transverse to a direction of travel. The details relating to the distances are applicable in particular to a neutral position of the axle assembly. The distance ratios indicated result in the desired handling performance. Furthermore, in this way only a small installation space is taken up.

In one embodiment, the articulated arms include an angle of 85°-95° relative to each other in every deflection position, this angle remaining essentially constant.

Preferably, the two articulated arms are of equal length. In particular, the two articulated arms are configured as identical parts.

One variant provides that a distance between each of the pivots on the wheel axle side and the associated pivot on the connection plate side deviates by a maximum of 35% from the distance between the two pivots on the connection plate side. This results in pleasant and safe handling characteristics and in a small installation space required.

In a preferred configuration, in a side view the pivots on the wheel axle side and the pivots on the connection plate side each include an angle of from 0° to 80° with a connection plane of the connection plate. In a side view of the skateboard axle assembly, which is in a neutral position, therefore only a side surface of the connection plate is visible. If the skateboard axle assembly is mounted to a skateboard deck, the skateboard deck is horizontal in this position. By means of the above-mentioned angular range, the return characteristic of the skateboard axle assembly, on the one hand, and the directional stability when moving straight ahead and also the agility during cornering, on the other hand, can be adjusted. The angle is selected such that the desired handling performance is obtained.

In a side view, the pivots on the wheel axle side and the pivots on the connection plate side may be inclined forward or rearward in the direction of travel. If the pivots are inclined forward in the direction of travel, the pivots on the connection plate side are located in front of the pivots on the wheel axle side in the direction of travel, and all pivots point obliquely upward and forward in the direction of travel. If the axle assembly is utilized in a reverse orientation, the pivots on the wheel axle side are located in front of the pivots on the connection plate side as seen in the direction of travel. In this case, the pivots point obliquely rearward and upward as viewed in the direction of travel.

Preferably, in a side view, the pivots on the wheel axle side and the pivots on the connection plate side each include an angle of 0° to 15°, preferably of 0° to 10°, with the connection plane of the connection plate. These angular ranges are preferentially selected if the skateboard axle assembly is used as the rear axle assembly. In the extreme case, i.e. when the angle is 0°, the axle assembly merely assists in a tilting or rocking movement of the connection plate relative to the wheel axle and thus of the skateboard deck relative to the wheel axle. There is then no contribution to steering. This results in a riding feel as is known from surfing or snowboarding.

Alternatively, in a side view, the pivots on the wheel axle side and the pivots on the connection plate side each include an angle of 45° to 80°, preferably of 65° to 75°, with the connection plane of the connection plate. These angular ranges are preferably applied if the skateboard axle assembly is used as the front axle assembly. The angle may amount to 70°, for example. The rider of a skateboard having such a skateboard axle assembly will have a riding feel as in surfing or snowboarding.

Furthermore, one embodiment provides that, in a top view, the pivots on the wheel axle side and the pivots on the connection plate side extend parallel to a longitudinal direction of the connection plate. In regard to traveling straight ahead, this results in a neutral handling characteristic of the skateboard axle assembly and, therefore, of the skateboard. This means that equally large forces have to be applied for left turns and right turns.

Further, in a front view, the pivots on the wheel axle side and the pivots on the connection plate side may extend substantially perpendicularly with respect to an upper connecting plane of the connection plate to the skateboard deck. In the state in which the skateboard axle assembly is mounted to a skateboard deck, the front view corresponds to a view contrary to the direction of travel of the skateboard. The skateboard axle assembly is in the neutral position here. Thus, the result is a neutral adjustment of the skateboard axle assembly with regard to left and right turns.

In one design variant, the articulated arms have a fork-shaped configuration at least at one end to form a joint, preferably the respective end of the articulated arms on the connection plate side having a fork-shaped configuration. As an alternative, the portion on the wheel axle side of the joint or the part on the connection plate side of the joint may also have a fork-shaped configuration. This design makes the skateboard axle assembly mechanically stable and thus durable.

In a preferred embodiment, the connection plate has exactly three openings arranged therein for mounting the axle assembly to the skateboard deck, a first opening being positioned on a longitudinal axis of the connection plate, and second and third openings being spaced apart from the first opening in the direction of the longitudinal axis of the connection plate and being positioned on opposite sides of the longitudinal axis of the connection plate, the openings preferably being holes or elongated holes. These openings allow the skateboard axle assembly to be mounted simply and stably to a skateboard deck with the aid of screws. If the openings are in the form of elongated holes, a fine adjustment of the distance between the axles can be performed.

In one design variant, the connection plate has exactly four openings arranged therein for mounting the axle assembly to the skateboard deck, the four openings being arranged in a rectangle that is symmetrical with respect to a longitudinal axis of the connection plate and preferably being elongated holes. The skateboard axle assembly may thus be mounted in a simple and stable manner to any commonly used skateboard deck. The configuration of the openings in the form of elongated holes allows the skateboard axle to be mounted independently of the selected distances of the mounting openings in the skateboard deck. In addition, a fine adjustment of the distance between the axles may be effected by means of the elongated holes.

Additionally, at least one stop member may be attached to the connection plate in such a way that it limits a deflection of the articulated arms. The deflection of the articulated arms is limited such that wheels mounted to the wheel axle do not come into contact with the skateboard deck when the skateboard axle assembly is mounted to a skateboard deck. This results in a safe handling performance of the skateboard axle and thus of the skateboard.

In one variant configuration, the articulated arms are coupled to the connection plate by means of an intermediate piece protruding downward from the lower side of the connection plate, the intermediate piece preferably being configured in one piece with the connection plate. This results in a simple structure, and the skateboard axle is simple to mount.

Preferably, the intermediate piece functions as the stop member. Only few components are therefore necessary for the skateboard axle assembly. The intermediate piece and stop member may, for example, be positioned between the articulated arms in a neutral position of the skateboard axle assembly.

In a preferred embodiment, the blocking position of at least one articulated arm corresponds to a position thereof in the direction of travel or in the direction of the longitudinal axis of the skateboard deck.

A further object of the present invention is to provide a skateboard which can be propelled by the so-called pumping and which allows small curve radii to be made when riding it.

This object is achieved by a skateboard having at least one skateboard axle assembly according to the invention. Such a skateboard allows, for one thing, very small curve radii and, for another thing, a propelling of the skateboard by means of pumping.

Preferably, the skateboard has a skateboard axle assembly of the type initially mentioned and a conventional axle assembly, the skateboard axle assembly of the type initially mentioned preferably being arranged at the front in the direction of travel and the conventional axle assembly preferably being arranged at the rear in the direction of travel, steering in the same direction as the front one, rather than in the opposite direction as customary hitherto. In this context, conventional axle assemblies are understood to mean in particular those skateboard axle assemblies which are provided with bushings, rather than with a four-joint mechanism.

An additional variant configuration makes provision that the skateboard includes two skateboard axle assemblies according to the invention and that the skateboard axle assemblies are oriented in the same direction or in opposite directions.

If the skateboard axle assemblies are oriented in the same direction, this means that the pivots on the wheel axle side and the pivots on the connection plate side of both skateboard axle assemblies mounted to the skateboard are oriented in the same direction. However, deviations may exist in the angular orientations of the pivots on the wheel axle side and the pivots on the connection plate side of the two skateboard axle assemblies. If the skateboard axle assemblies are oriented in opposite directions, the pivots on the wheel axle side and the pivots on the connection plate side of the skateboard axle assembly which is at the front in the direction of travel point in a different direction from the pivots on the wheel axle side and the pivots on the connection plate side of the skateboard axle assembly which is at the rear in the direction of travel. For example, the pivots on the wheel axle side and on the connection plate side of the front axle assembly may, in a side view, point obliquely upward and forward, and the pivots on the wheel axle side and on the connection plate side of a rear axle assembly may, in a side view, point obliquely rearward and upward.

Moreover, the pivots on the wheel axle side and the pivots on the connection plate side of a skateboard axle assembly of the type initially mentioned that is arranged at the rear in the direction of travel may be arranged substantially parallel to a longitudinal direction of the skateboard. The rear axle thus does not contribute to steering of the skateboard. It merely assists in a tilting or rocking movement of the skateboard deck by permitting it.

BRIEF DESCRIPTION OF THE DRAWINGS

The invention will now be explained below with reference to various exemplary embodiments, which are shown in the accompanying drawings, in which.

DETAILED DESCRIPTION OF THE INVENTION

Figure 1:
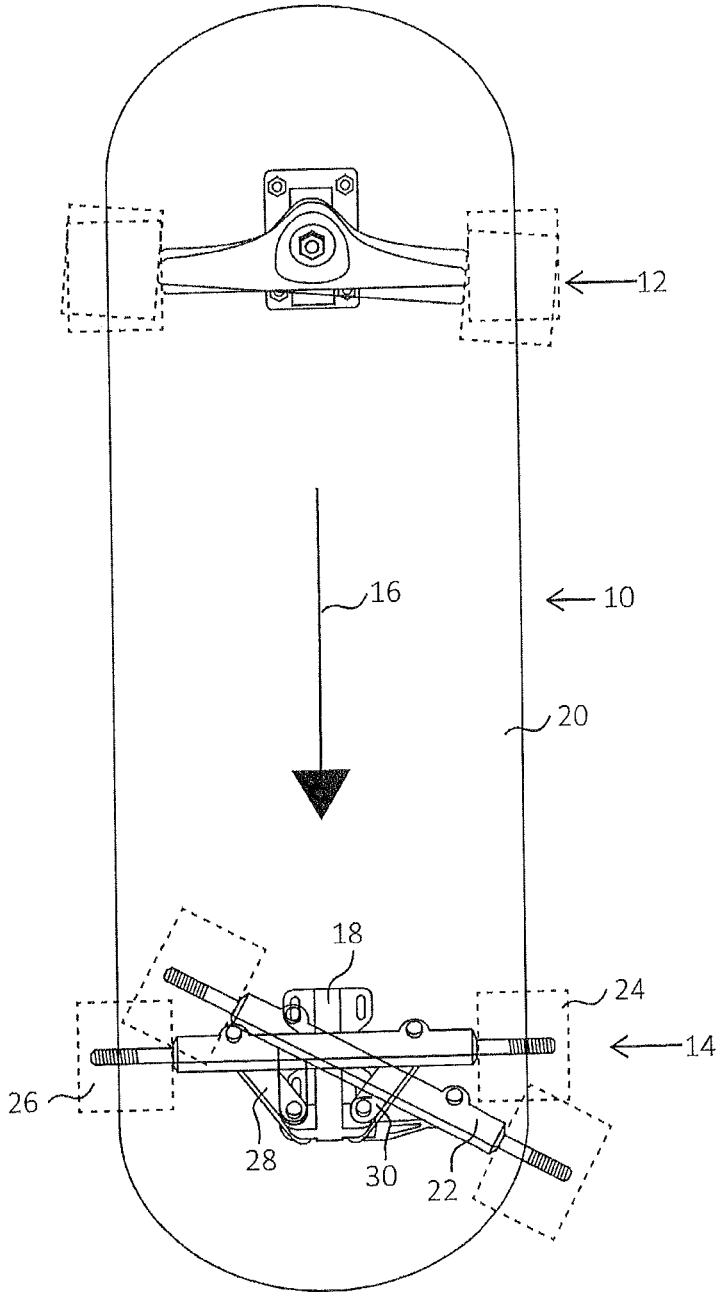
FIG. 1 shows a skateboard according to the invention, with a skateboard axle assembly according to the invention in a bottom view.

FIG. 1 shows a skateboard 10 which has two skateboard axle assemblies 12, 14. In a direction of travel 16 of the skateboard 10, the skateboard axle assembly 14 is mounted in front of the skateboard axle assembly 12.

Both skateboard axle assemblies 12, 14 are shown in a neutral position, which corresponds to a straight-ahead travel of the skateboard 10 along the direction of travel 16, and in a deflected position.

The skateboard axle assembly 14 is mounted to a skateboard deck 20 by means of a connection plate 18. Furthermore, the skateboard axle assembly 14 has a wheel axle 22, at the two ends of which a respective wheel 24, 26 is mounted. The wheel axle 22 is movably coupled to the connection plate 18 via two articulated arms 28, 30.

The axle assembly 12 is an axle assembly according to the prior art, having a bushing by means of which the wheel axle is coupled to the skateboard deck 20 and which ensures a return movement to the neutral position. Such an axle assembly is referred to as a conventional axle assembly.

Figure 2:
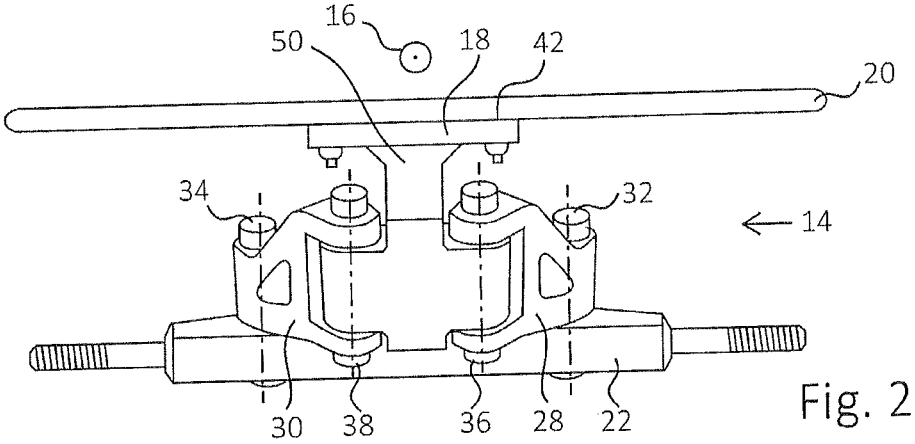
FIGS. 2 to 5 show a first embodiment of the skateboard axle assembly according to the invention in a neutral position.
Figure 3:
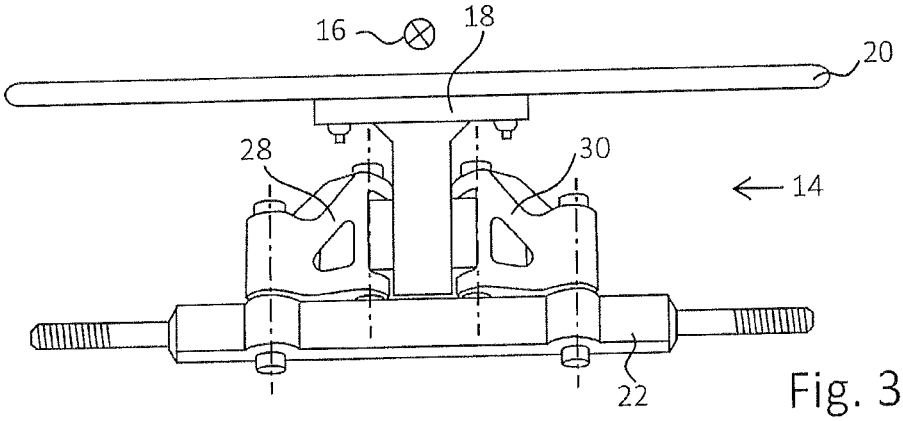
Figure 4:
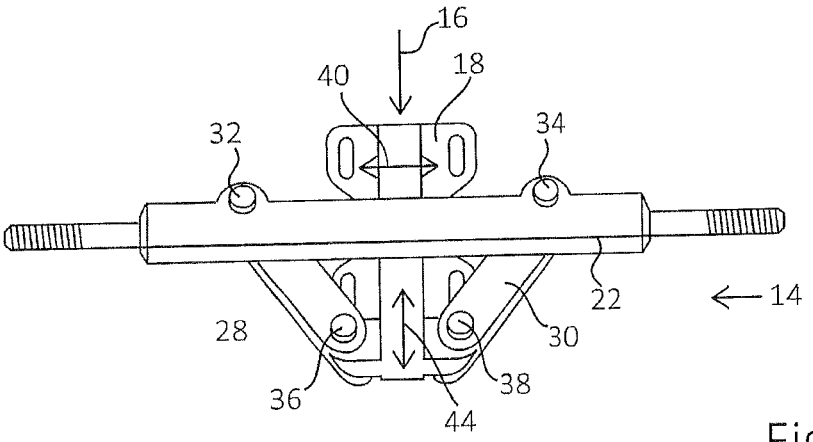
Figure 5:
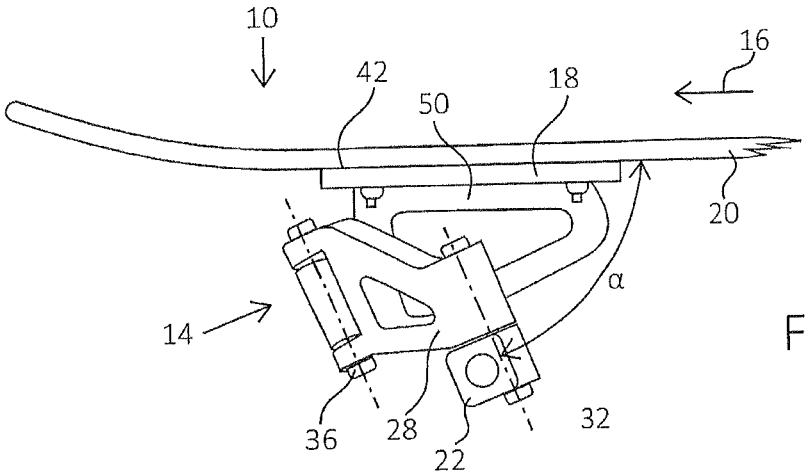

In FIGS. 2 to 5, the skateboard axle assembly 14 is illustrated in a neutral position. FIG. 2 shows the skateboard axle assembly 14 in a front view here. The perspective taken here is in the direction of travel 16 in front of the axle. In FIG. 3 the skateboard axle assembly 14 is shown in a rear view. The perspective taken here is behind the skateboard axle assembly 14 in the direction of travel 16. FIG. 4 shows the skateboard axle assembly 14 in a view from below. In FIG. 5 the skateboard axle assembly 14 is illustrated in a side view.

The articulated arm 28 is mounted at the wheel axle 22 for rotation via a pivot 32 on the wheel axle side. In the same way, the articulated arm 30 is mounted at the wheel axle 22 for rotation via a pivot 34 on the wheel axle side.

Furthermore, the articulated arm 28 is rotatably connected to the connection plate 18 via a pivot 36 on the connection plate side. In the illustrated embodiment, the pivot 36 on the connection plate side constitutes an axis of rotation.

Likewise, the articulated arm 30 is rotatably connected to the connection plate 18 via a pivot 38 on the connection plate side. In the illustrated embodiment, the pivot 38 on the connection plate side also constitutes an axis of rotation. All of the pivots 32, 34, 36, 38 are formed by pins.

As is apparent from FIGS. 2 to 4 in particular, the structure of the skateboard axle assembly 14 in the neutral position shown is symmetrical to a vertical central or longitudinal axis. This results in two parallel force profiles through the two articulated arms 28, 30.

It can be seen from FIG. 4 that the pivots 32, 34 on the wheel axle side are spaced apart from each other along the wheel axle 22. Likewise, the pivots 36, 38 on the connection plate side are spaced apart from each other along a transverse direction 40 of the connection plate. In the neutral position of the skateboard axle assembly 14 as illustrated, the transverse direction 40 of the connection plate (see FIG. 4) is parallel to the direction of the wheel axle 22.

The distance between the pivots 32, 34 on the wheel axle side is selected to be greater here than the distance between the pivots 36, 38 on the connection plate side (see FIG. 4). In particular, the distance between the pivots 32, 34 on the wheel axle side is 2 to 2.5 times greater than the distance between the pivots 36, 38 on the connection plate side.

In the illustrated embodiment, the distance between the pivots 32, 34 on the wheel axle side is essentially twice as large as the distance between the pivots 36, 38 on the connection plate side.

The distances between the pivots on the wheel axle side that belong together and the pivots on the connection plate side that belong together are also predefined. That is, the distance between each of the pivots 32, 34 on the wheel axle side and its associated pivot 36 and 38 on the connection plate side, respectively, deviates by a maximum of 35% from the distance between the two pivots 36, 38 on the connection plate side.

The distance between one of the pivots 32, 34 on the wheel axle side and the respectively associated pivot 36, 38 on the connection plate side corresponds to the effective length of the associated articulated arm 28, 30.

The operating principle of the skateboard axle assembly 14 is thus based on a symmetrically structured four-joint mechanism.

It is apparent from FIGS. 2 and 3 that both the pivots 36, 38 on the connection plate side and the pivots 32, 34 on the wheel axle side extend perpendicularly to a connection plane 42 of the connection plate 18 to the skateboard deck 20 in a front view (cf. FIG. 2).

Furthermore, it is apparent from FIGS. 3 and 4, for example, that in a top view the pivots 32, 34, 36, 38 extend parallel to a longitudinal direction 44 of the connection plate 18.

FIG. 5 shows the skateboard axle assembly 14 in a side view. The skateboard 10 is illustrated only partly.

In the direction of travel 16 the pivots 36, 38 on the connection plate side, at which the articulated arms 28, 30 are mounted for rotation, are now located in front of the pivots 32, 34 on the wheel axle side of the articulated arms 28, 30. The pivots 32-38 extend parallel in space, with the pivots 32, 34 being located vertically slightly lower in relation to the pivots 36, 38.

The pivots 32-38 include an angle $\alpha$ with the connection plane 42 of the connection plate 18. The angle $\alpha$ may be between 0° and 80° here.

In a preferred embodiment of the skateboard axle assembly 14, the angle $\alpha$ amounts to 0° to 15°, preferably to 0° to 10°. These angular ranges are preferably used if the skateboard axle assembly 14 is installed as the rear axle.

When used as a rear axle, the skateboard axle assembly 14 may be mounted to the skateboard deck 20 in the orientation illustrated in FIG. 5, in which the pivots 36, 38 on the connection plate side are each located in front of the associated pivots 32, 34 on the wheel axle side in the direction of travel 16. Alternatively, the skateboard axle assembly 14 may be installed in an orientation opposite to that of FIG. 5. Then the pivots 36, 38 on the connection plate side are each located behind the associated pivots 32, 34 on the wheel axle side in the direction of travel 16.

As an alternative, the angle $\alpha$ may be between 45° and 80°, preferably between 65° and 75°. In the embodiment shown, the angle $\alpha$ amounts to approx. 70°. These angle sizes are preferably employed if the skateboard axle assembly 14 is used as the front axle.

When used as a front axle, the skateboard axle assembly 14 may be mounted to the skateboard deck 20 in the orientation illustrated in FIG. 5, in which the pivots 36, 38 on the connection plate side are each located in front of the associated pivots 32, 34 on the wheel axle side in the direction of travel 16.

Alternatively, the skateboard axle assembly 14 may be installed in an orientation opposite to that of FIG. 5. The pivots 36, 38 on the connection plate side are then each located behind the associated pivots 32, 34 on the wheel axle side in the direction of travel 16.

Figure 6:
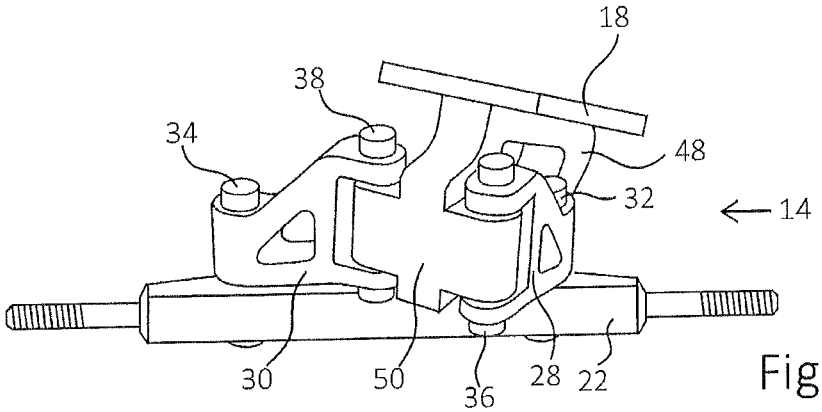
FIGS. 6 and 7 show a first embodiment of the skateboard axle assembly according to the invention in a deflected position.
Figure 7:
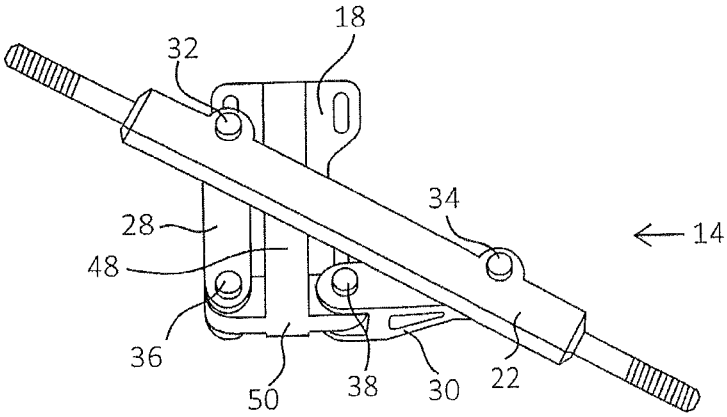

FIGS. 6 and 7 show the skateboard axle assembly 14 in a deflected position, compared to the neutral position shown in FIGS. 2 to 5. This deflected position corresponds to a cornering of the skateboard 10.

In FIG. 6, the skateboard axle assembly 14 can be seen in a front view. Here, the connection plate 18 has been swiveled relative to the wheel axle 22. This swiveling is carried out by the rider of the skateboard 10 by shifting his/her weight. In the embodiment illustrated in FIG. 6, the swiveling corresponds to a left turn (cf. FIG. 1).

The deflection illustrated in FIGS. 6 and 7 corresponds to the maximum deflection of the wheel axle 22 in relation to the connection plate 18, corresponding to a minimum curve radius of the skateboard 10.

The deflection of the articulated arms 28, 30 is limited by a stop member 48 here. In FIG. 7, the articulated arm 28 strikes the stop member 48, which means that the articulated arm 28 cannot rotate any further clockwise with respect to the pivot 36 on the connection plate side. The stop member 48 is always arranged between the two articulated arms 28, 30.

When, starting from the position in FIG. 7, the articulated arm 28 is swiveled counterclockwise about the pivot 36 on the connection plate side, the articulated arm 30 is swiveled counterclockwise about the pivot 38 on the connection plate side owing to the coupling via the wheel axle 22. This swiveling can only be carried out until the articulated arm 30 strikes the stop member 48.

As can be seen from FIGS. 4 and 7, the articulated arms 28, 30 include an angle of 85° to 95° relative to each other in each deflection position.

Furthermore, it can be seen from FIGS. 1 to 7 that the pivots 36, 38 on the connection plate side are connected to the connection plate 18 by means of an intermediate piece 50.

In the illustrated embodiment, the intermediate piece 50 and the connection plate 18 are configured in one piece. In addition, in the illustrated embodiment the intermediate piece 50 also functions as the stop member 48.

In the embodiment of the skateboard axle assembly illustrated in FIGS. 1 to 7, the two articulated arms 28, 30 are designed to be fork-shaped on that side that cooperates with the pivot 36, 38 on the connection plate side. This constitutes a design embodiment corresponding to the load. Alternatively, the other ends of the articulated arms 28, 30 may of course also be designed to be fork-shaped.

In the embodiment according to FIG. 1, the forward-facing axle assembly 12 steers in the same direction as the front one, rather than in the opposite direction, as was customary so far.

The skateboard axle assembly 14 has been explained for the embodiment of the skateboard 10 as shown in FIG. 1. The skateboard axle assembly 14 may, however, also be mounted to the deck 20 of the skateboard 10 so as to be oriented oppositely with respect to the direction of travel 16.

In addition, as already mentioned, the skateboard axle assembly 14 may also be used as the rear axle. It could then replace the skateboard axle assembly 12.

Even if the skateboard axle assembly 14 is used as the rear axle, the skateboard axle assembly 14 may be used in two possible orientations with respect to the direction of travel 16.

Figure 8:
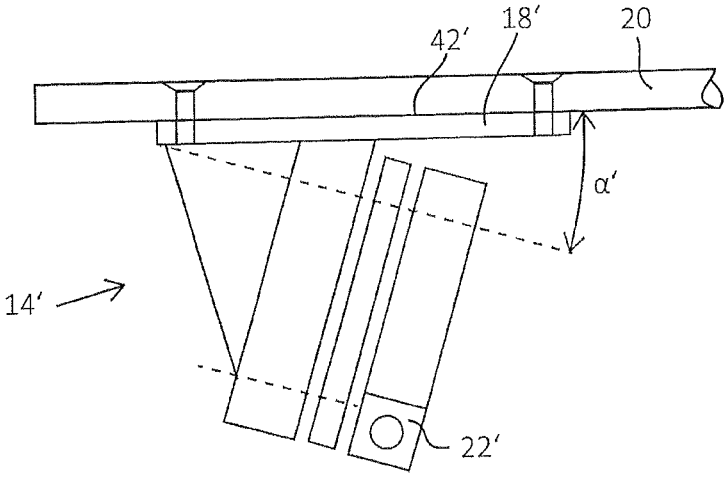
FIGS. 8 to 10 show a second embodiment of the skateboard axle assembly according to the invention.
Figure 9:
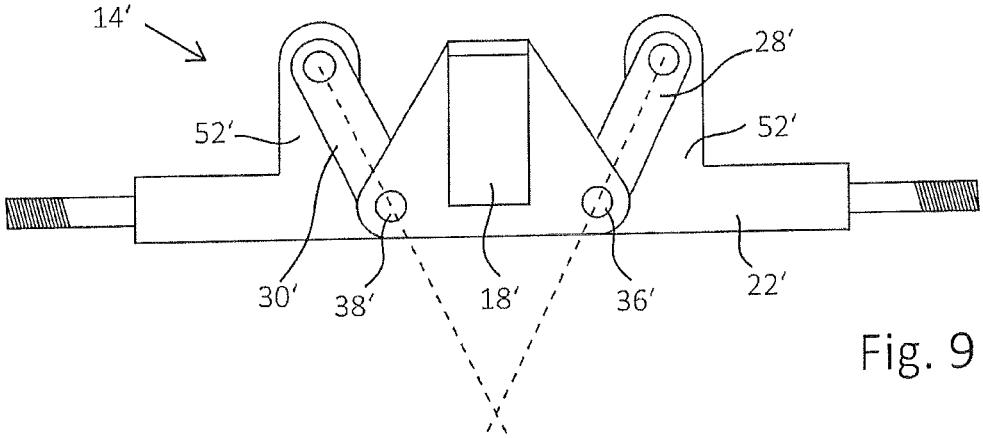
Figure 10:
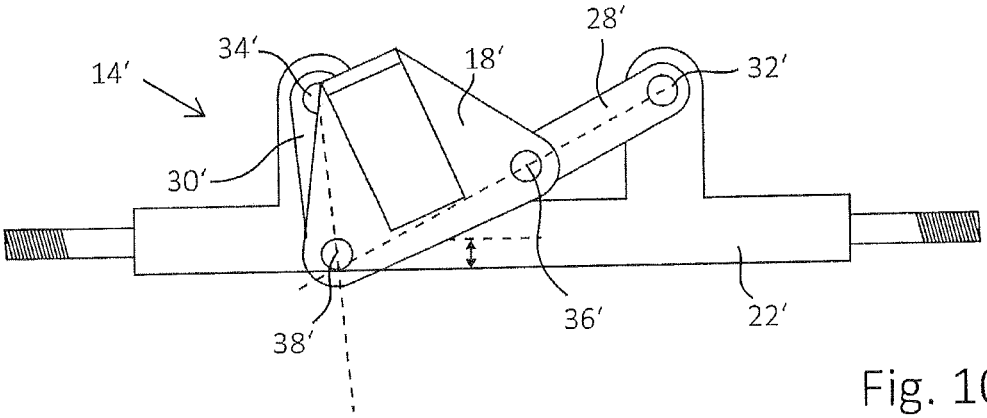

FIGS. 8 to 10 show a second embodiment of the skateboard axle assembly 14'. FIG. 8 is a side view which corresponds to FIG. 5. The skateboard axle assembly 14' is in a neutral position here. FIG. 9 is a view of the skateboard axle assembly 14' obliquely from the front and top in a neutral position, and FIG. 10 is a view of the skateboard axle assembly 14' in a deflected position.

Since the skateboard axle assembly 14' largely corresponds to the skateboard axle assembly 14, only the differences will be discussed below.

The embodiment of FIGS. 8 to 10 differs from the first embodiment shown in FIGS. 1 to 7 essentially by the configuration of the articulated arms 28', 30'. In the second embodiment, the articulated arms 28', 30' are flat. They may be made, for example, of sheet steel or from a fiber composite material, in particular CFRP or GFRP.

Furthermore, in the second embodiment, the angle $\alpha'$ is selected to be significantly smaller than in the first one. The embodiment illustrated in FIGS. 8 to 10 is therefore preferably used as the rear axle.

The wheel axle 22' comprises extensions 52' at which the pivots 32', 34' on the wheel axle side are mounted. These extensions 52' can be used for setting the distance between the wheel axle 22' and the pivots 32', 34' on the wheel axle side.

This distance influences the turn-in ability of the skateboard axle assembly 14' and thus the handling performance of the skateboard 10.

The raising of the deck upon deflection from the neutral position (straight ahead travel) is symbolized in FIG. 10 by the double arrow. This principle of the axle assembly also applies to the previous embodiment.

In addition, in the second embodiment the distances between the pivots 32', 34' on the wheel axle side and the respectively associated pivots 36', 38' on the connection plate side are selected such that they correspond to the distance between the two pivots on the connection plate side. In other words, the distance between the pivot 32' on the wheel axle side and the associated pivot 36' on the connection plate side corresponds to the distance between the pivot 36' on the connection plate side and the pivot 38' on the connection plate side. Likewise, the distance between the pivot 34' on the wheel axle side and the pivot 38' on the connection plate side corresponds to the distance between the two pivots 36', 38' on the connection plate side.

Figure 11:
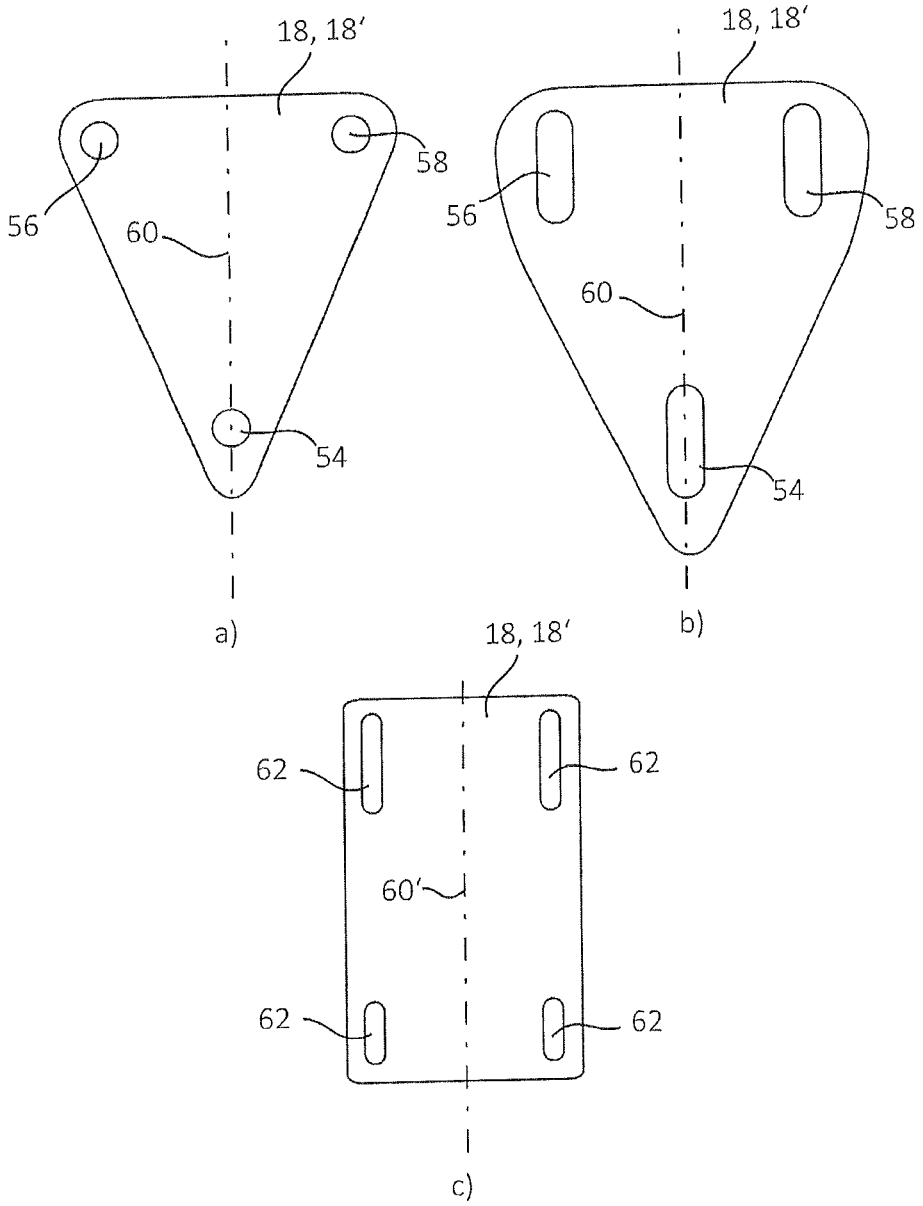
FIG. 11 shows three embodiments of a connection plate of a skateboard axle assembly according to the invention.

FIG. 11 schematically shows three embodiments of the connection plate 18, 18'. The two embodiments a) and b) have exactly three openings 54, 56, 58 for mounting the connection plate 18, 18' and thus the axle assembly 14, 14' to the skateboard deck 20.

A first opening 54 is arranged on a longitudinal axis 60 of the connection plate here. The longitudinal axis 60 of the connection plate may also be referred to as the central axis of the connection plate.

A second and a third opening 56, 58 are spaced apart from the first opening 54 in the direction of the longitudinal axis 60 of the connection plate. In addition, the second and third openings 56, 58 are arranged on opposite sides of the longitudinal axis 60 of the connection plate and spaced apart from it.

The openings 54, 56, 58 are preferably in the form of holes or elongated holes.

In the embodiment according to FIG. 11 *c*), four elongated holes 62 are arranged in the connection plate 18, 18', the elongated holes 62 forming a rectangle which is symmetrical with a longitudinal axis 60' of the connection plate.

As can be seen in FIG. 11 *c*), the extent of the elongated holes 62 along the longitudinal axis 60' of the connection plate may be different.

Figure 12:
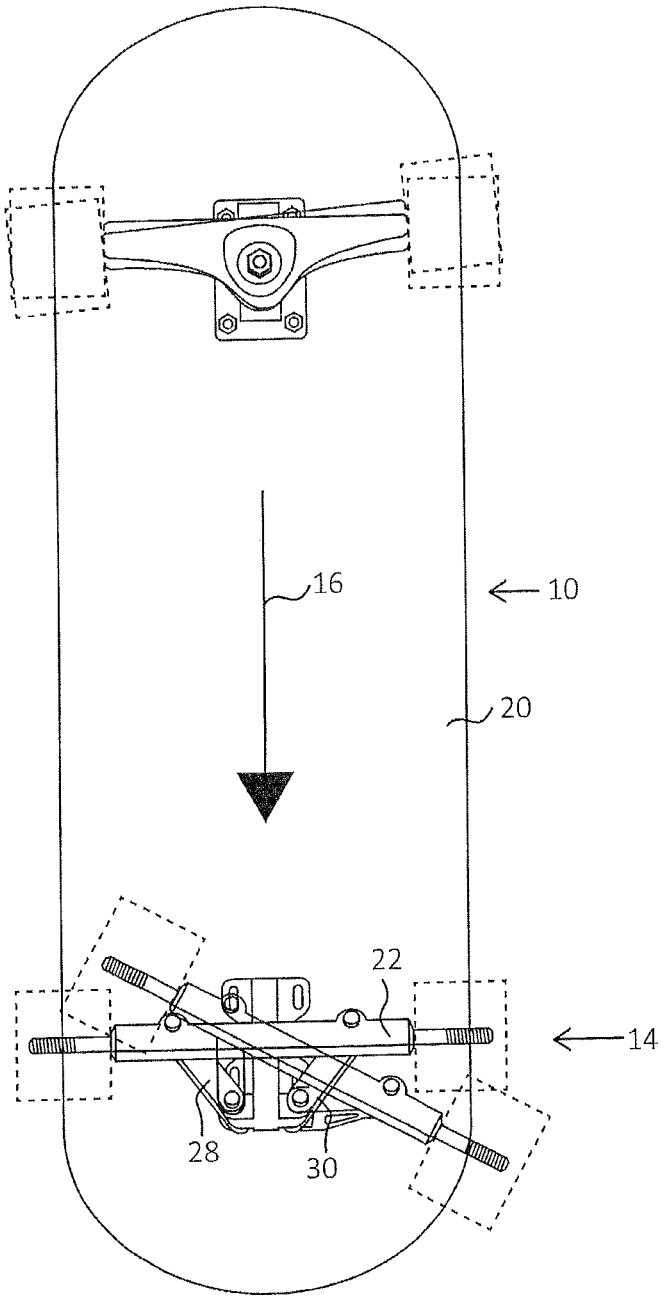
FIGS. 12 to 14 show three further embodiments of the skateboard according to the invention.

FIG. 12 shows an alternative embodiment of the skateboard 10 in which the skateboard axle assembly 14 and the skateboard axle assembly 12 are mounted to the skateboard deck 20 as front and rear axle assemblies, respectively. In contrast to the embodiment according to FIG. 1, the skateboard axle assembly 12 is mounted in an opposite orientation.

Figure 13:
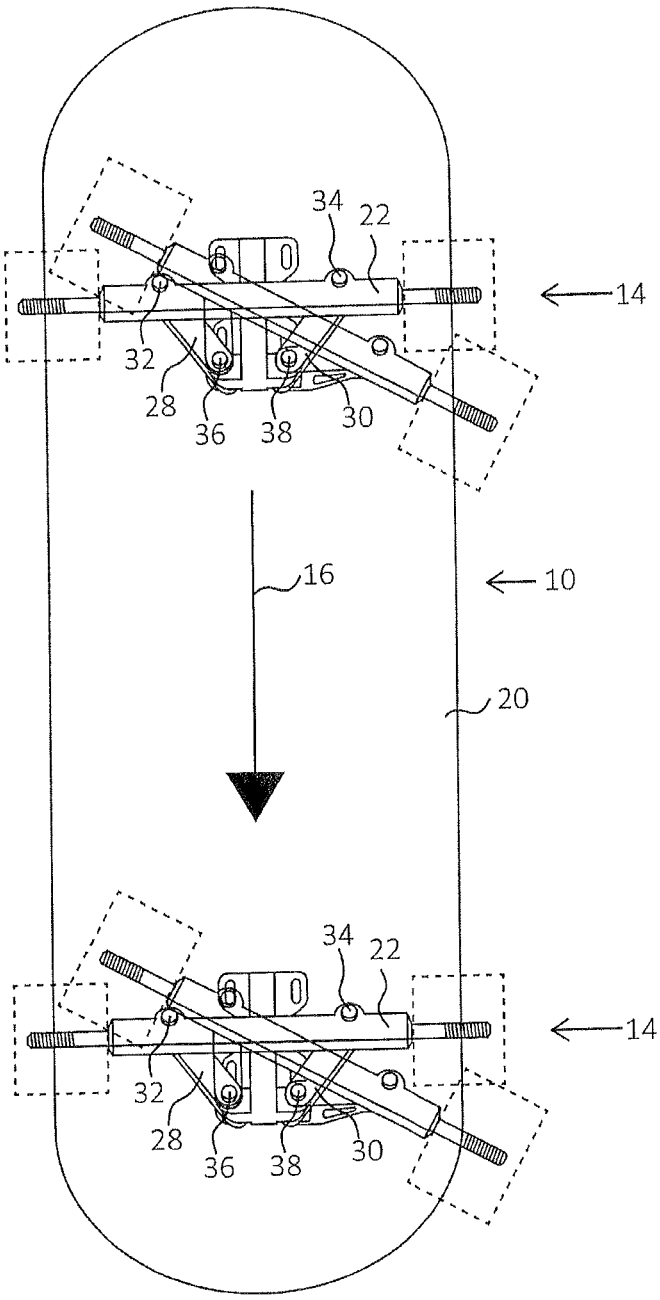

FIG. 13 shows a further alternative embodiment of the skateboard 10 which has two skateboard axle assemblies 14 mounted thereto, the two skateboard axle assemblies being oriented in the same direction. This means that, as viewed in the direction of travel 16, the pivots 36, 38 on the connection plate side are located in front of the pivots 32, 34 on the wheel axle side for both skateboard axle assemblies 14.

Figure 14:
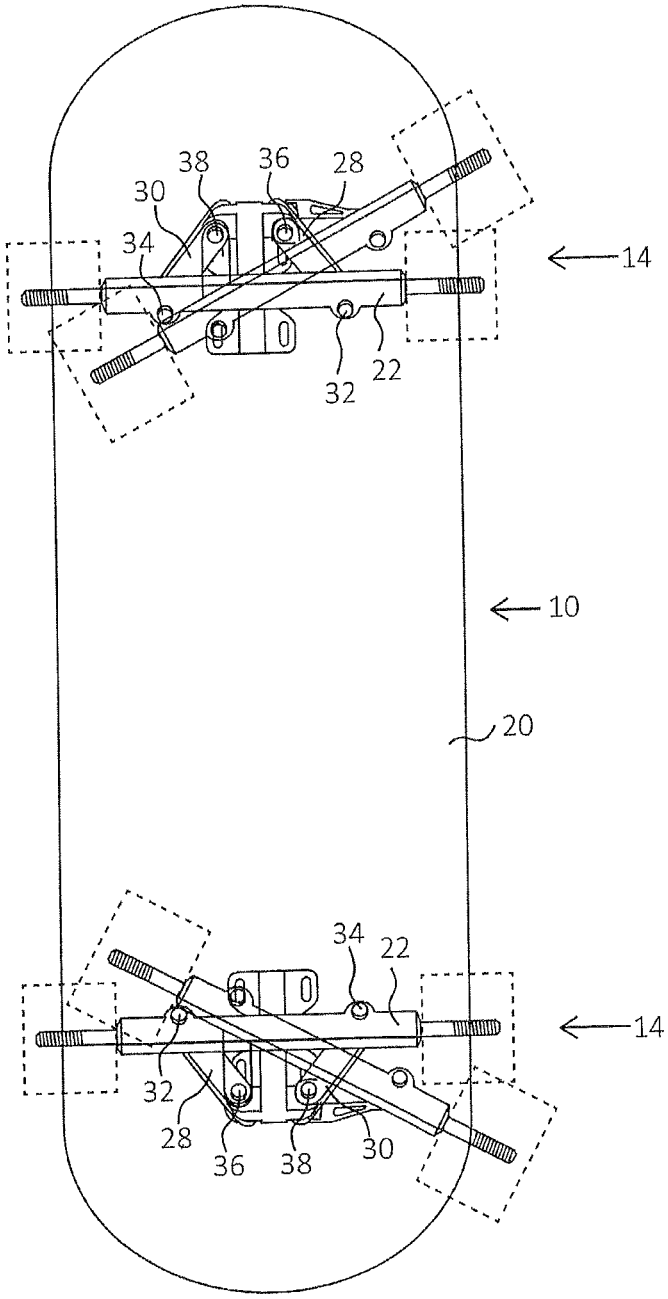

An additional alternative embodiment of the skateboard 10 can be seen from FIG. 14. In this embodiment as well, two skateboard axle assemblies 14 are mounted to the skateboard deck 20. In contrast to the embodiment according to FIG. 13, however, the skateboard axle assemblies 14 are oriented in opposite directions. This means that for both skateboard axle assemblies 14, the pivots 36, 38 on the connection plate side are closer to the associated end of the skateboard deck 20 than the pivots 32, 34 on the wheel axle side.

Since the embodiment according to FIG. 14 is structured symmetrically with respect to a longitudinal axis of the skateboard, it has no preferred direction of travel.

The embodiments of the skateboard 10 according to FIGS. 1, 12, 13 and 14 have been discussed by reference to the skateboard axle assembly 14. These embodiments of the skateboard 10 may, of course, also be equipped with the skateboard axle assembly 14'.

Moreover, the embodiments according to FIGS. 13 and 14 may comprise one skateboard axle assembly 14 and one skateboard axle assembly 14' each.

The invention claimed is:

1. A skateboard axle assembly comprising a connection plate for mounting the axle assembly to a skateboard deck and a wheel axle having two ends, to each of which a wheel can be mounted, wherein the wheel axle is movably coupled to the connection plate by two articulated arms;

wherein the articulated arms are each supported at the wheel axle for rotation about a respective pivot on the wheel axle side, wherein each of the respective pivots on the wheel axle side constitute an axis of rotation respectively, wherein the articulated arms are each supported at the connection plate for rotation about a respective pivot on the connection plate side, wherein the pivots on the connection plate side constitute an axis of rotation respectively, wherein in a front view, the pivot axes of the pivots on the wheel axle side and the pivot axes of the pivots on the connection plate side extend substantially perpendicularly with respect to a connection plane of the connection plate, and wherein in a side view, the pivot axes of the pivots on the wheel axle side and the pivot axes of the pivots on the connection plate side each include an angle of 0° to 80° with the connection plate of the connection plate.

2. The skateboard axle assembly according to claim 1, wherein the axle assembly is configured without bushings.

3. The skateboard axle assembly according to claim 1, wherein the pivots on the wheel axle side are spaced apart from each other along the wheel axle and the pivots on the connection plate side are spaced apart from each other along a transverse direction of the connection plate, the distance between the two pivots on the wheel axle side being larger than the distance between the pivots on the connection plate side, and/or the articulated arms including an angle of 85° to 95° relative to each other in a deflection position.

4. The skateboard axle assembly according to claim 3, wherein a distance between each of the pivots on the wheel axle side and the associated pivot on the connection plate side deviates by a maximum of 35% of the distance between the respective pivot on the wheel axle side and the associated pivot on the connection plate side from the distance between the two pivots on the connection plate side.

5. The skateboard axle assembly according to claim 3, wherein the distance between the two pivots on the wheel axle side is 2 to 2.5 times as large as the distance between the pivots on the connection plate side.

6. The skateboard axle assembly according to claim 1, wherein in a side view, the pivot axes of the pivots on the wheel axle side and the pivot axes of the pivots on the connection plate side each include an angle ($\alpha$, $\alpha'$) of 0° to 15° with the connection plane of the connection plate.

7. The skateboard axle assembly according to claim 1, wherein in a side view, the pivot axes of the pivots on the wheel axle side and the pivot axes of the pivots on the connection plate side each include an angle ($\alpha$, $\alpha'$) of 45° to 80° with the connection plane of the connection plate.

8. The skateboard axle assembly according to claim 1, wherein in a top view, the pivot axes of the pivots on the wheel axle side and the pivot axes of the pivots on the connection plate side extend parallel to a longitudinal direction of the connection plate.

9. The skateboard axle assembly according to claim 1, wherein the articulated arms have a fork-shaped configuration at least at one end to form a joint.

10. The skateboard axle assembly according to claim 1, wherein the connection plate has exactly three openings arranged therein for mounting the axle assembly to the skateboard deck, a first opening being positioned on a longitudinal axis of the connection plate, and second and third openings being spaced apart from the first opening in the direction of the longitudinal axis of the connection plate and being positioned on opposite sides of the longitudinal axis of the connection plate.

11. The skateboard axle assembly according to claim 1, wherein the connection plate has exactly four openings arranged therein for mounting the axle assembly to the skateboard deck, the four openings being arranged in a rectangle that is symmetrical with respect to a longitudinal axis of the connection plate.

12. The skateboard axle assembly according to claim 1, wherein at least one stop member is attached to the connection plate such that the stop member limits a deflection of the articulated arms.

13. The skateboard axle assembly according to claim 1, wherein the articulated arms are coupled to the connection plate by an intermediate piece protruding downward from a lower side of the connection plate.

14. The skateboard axle assembly according to claim 1, wherein the articulated arms are arranged in relation to each other and articulated to the connection plate and the axle assembly such that when the axle assembly is horizontal, the connection plate is in its lowest position, and when placed in an inclined position, the connection plate is moved vertically upward.

15. A skateboard comprising two skateboard axle assemblies each being a skateboard axle assembly comprising:

a connection plate for mounting the axle assembly to a skateboard deck and a wheel axle having two ends, to each of which a wheel can be mounted, wherein the wheel axle is movably coupled to the connection plate by two articulated arms, wherein the articulated arms are each supported at the wheel axle for rotation about a respective pivot on the wheel axle side, wherein the respective pivots on the wheel axle side constitute an axis of rotation respectively, wherein the articulated arms are each supported at the connection plate for rotation about a respective pivot on the connection plate side, wherein the pivots on the connection plate side constitute an axis of rotation respectively, wherein in a front view, the pivot axes of the pivots on the wheel axle side and the pivot axes of the pivots on the connection plate side extend substantially perpendicularly with respect to a connection plane of the connection plate, and wherein the said skateboard axle assemblies are oriented in the same direction or in opposite directions.

16. A skateboard axle assembly comprising a connection plate for mounting the axle assembly to a skateboard deck and a wheel axle having two ends, to each of which a wheel can be mounted, wherein the wheel axle is movably coupled to the connection plate by two articulated arms, wherein the articulated arms are each supported at the wheel axle for rotation about a respective pivot on the wheel axle side, wherein the respective pivots on the wheel axle side constitute an axis of rotation respectively, wherein the articulated arms are each supported at the connection plate for rotation about a respective pivot on the connection plate side, wherein the pivots on the connection plate side constitute an axis of rotation respectively, wherein in a front view, the pivot axes of the pivots on the wheel axle side and the pivot axes of the pivots on the connection plate side extend substantially perpendicularly with respect to a connection plane of the connection plate, and wherein in a top view, the pivots on the wheel axle side and the pivots on the connection plate side extend parallel to a longitudinal direction of the connection plate.

* * * * *